United States Patent [19]

Croullebois

[11] 3,941,331

[45] Mar. 2, 1976

[54] CASING FOR APPARATUS PROVIDED WITH A FLEXIBLE OR ARTICULATED WINDABLE ELEMENT

[76] Inventor: Georges L. Croullebois, 55, Bld de Charonne - Batiment"Les Aulnes", 75011 Paris, France

[22] Filed: Feb. 22, 1974

[21] Appl. No.: 444,730

[30] Foreign Application Priority Data

Mar. 29, 1973 France ..... 73.11252

[52] U.S. Cl. ..... 242/118; 242/137

[51] Int. Cl.[2] ..... B65H 75/20; B65H 75/14

[58] Field of Search..... 242/117, 118.4, 54 R, 159, 242/137, 137.1, 118, 129.8, 125, 125.1; 114/206, 209

[56] References Cited

UNITED STATES PATENTS

| | | | |
|---|---|---|---|
| 445,598 | 2/1891 | McCahey | 242/118.4 |
| 2,696,951 | 12/1954 | Wood | 242/125.1 |
| 3,837,590 | 9/1974 | Pollak | 242/54 R |

*Primary Examiner*—Leonard D. Christian

*Attorney, Agent, or Firm*—Larson, Taylor and Hinds

[57] ABSTRACT

A device, conveniently in the form of a reel, for the housing of apparatus which is provided with a flexible or articulated windable element comprises a casing having two or more hollow components within which the apparatus is housed and around which the windable element is wound in such a manner as to constrain the components of the casing in the abutting positions which form the casing.

8 Claims, 18 Drawing Figures

CASING FOR APPARATUS PROVIDED WITH A FLEXIBLE OR ARTICULATED WINDABLE ELEMENT

BACKGROUND OF THE INVENTION

This invention relates to casings and, more particularly but not exclusively, to casings in the form of reels for the housing of apparatus which apparatus is provided with a flexible or articulated windable element.

It is often desirable to be able to store in a restricted space apparatus which is provided with a flexible or articulated windable element. Small electrical machines such as shavers and household drills are often provided with a cable and in the past monolithic reels have been provided for storage of the cable by coiling. Furthermore, it is often required to store conveniently a cable to which is attached a grapnel. For example, when containers dropped from aircraft are to be recovered at sea they often have attached to them a cable on the end of which is a grapnel. When ejecting such equipment from an aircraft it is convenient to ensure that the cable is coiled up, so that there is less danger of the grapnel fouling the aircraft during its ejection. However, the cable must be deployed in an uncoiled manner during the time when the container is floating on the water and so a storage means which allows the cable to uncoil during or immediately after descent is required.

SUMMARY OF THE INVENTION

According to the present invention there is provided a casing, for the housing of apparatus which is provided with a windable element, said casing comprising at least two components which may be brought together to a closed position of said casing and which may be moved relative to each other to an open position of said casing to allow egress of the apparatus from within said casing, and wherein there is provided in the said caasing an aperture for the passage therethrough when said casing is closed of a part of the said windable element whereby when said components of the casing have been brought together to close said casing with the apparatus within the casing, the said components may be constrained in the closed position by winding the said windable element around an outer surface of the casing.

A casing according to the present invention permits the housing in a restricted space of apparatus which is provided with a flexible or articulated windable element with the minimum bulk, and the automatic release of such apparatus if necessary. Furthermore, it is simple to produce and does not require any additional locking element.

DESCRIPTION OF THE PREFERRED EMBODIMENTS

Conveniently, the casing according to the invention comprises two components and takes the form of a central core formed of two hollow half-cylinders which can be mated along a plane containing the common longitudinal axis of the said half-cylinders and two substantially circular cheeks each formed of two half-cheeks having a mean radius greater than that of the said half-cylinders, each one of the four said half-cheeks being integral with one of the two plane faces of one of the two hollow half-cylinders of the said central core, the said central core containing at least one aperture formed in its surface of revolution at a point where the said aperture intersects the aforesaid plane, which aperture allows the passage therethrough of the said element the winding of which about the surface of revolution of the central core containing the apparatus to be housed effects the closing of the casing.

According to one embodiment of this convenient form of the invention, when the casing is closed the said half-cheeks are contiguous in an identical plane to that in which the said half-cylinders are contiguous.

According to another embodiment of this convenient form of the invention, when the casing is closed the said half-cheeks are contiguous in a longitudinal plane which is different from the plane in which the said half-cylinders are contiguous, which makes it possible to engage the two parts of the casing in one another.

If a casing according to the invention is to be used in the laying of mooring lines and/or for the immersion of apparatus such as a grapnel, the casing may constitute a float the two parts of which are connected together by one or a plurality of articulated joints. The or each such articulated joint may be composed of, for example, two staples each integral with a half-casing and connected together by at least one ring. The float may slide along the windable element and thus serve, for example, as a marking buoy. The grapnel, or other apparatus which is to be immersed, is housed within the casing, which casing is then closed and locked by the turns of the windable element which in this instance would normally be a chain or a rope which is secured at the end remote from the grapnel. On immersion, the combination of the casing and the grapnel or other apparatus to be immersed sinks having no overall floating ability and the rope or chain unwinds. When the rope or chain has unwound, the grapnel or other apparatus to be submerged is released, thus allowing the casing, which on its own has positive floating properties, to move up to the surface, sliding along the chain or rope.

A casing according to the present invention may also be used as part of a device for the recovery at sea of containers dropped from aircraft. The casing houses a grapnel secured to a windable element, in this instance a cable, which cable is wound on the said casing, the free end being connected to the container. When the aircraft carries out a dropping operation, the cable, casing and grapnel assembly is ejected outside the container. The cable unwinds and then releases the casing which separates to release the grapnel in its turn. This separation of the casing may be facilitated by appropriate design of the junction surface or surfaces of the components forming the casing. For example, in the aforementioned convenient form of the invention this may be achieved more particularly by curving, in the direction of rotation of the casing in its fall, the end of the contact surface of the half-cheeks which is diametrically opposite relatively to the aperture through which the connecting cable escapes. In this convenient form of the invention the unwinding of the cable can be braked by one or more members such as breaking wires of predetermined strength arranged between the cheeks of the casing through the agency of locating means provided for this purposes. After the container has fallen into the sea, the grapnel hangs vertically in the water on the end of its cable, which then meets the cable of a sweep towed by a ship. The grapnel then slides on the cable of the sweep until it encounters the sweep and is attached thereto. The container and sweep can then be hauled on board without difficulty.

The casing according to the present invention can be used for the housing of apparatus which is provided with a flexible or articulated windable element, and more particularly may be used for the housing of electrical apparatus such as drilling machines, shaving machines, etc. It can also be used for the provision of mooring lines of small bulk and devices for recovering containers at sea.

For a better understanding of the invention, reference will now be made, by way of example, to the accompanying drawings in which:

FIGS. 1 to 12 illustrates one embodiment of a casing according to the invention, FIG. 1 showing a view in perspective of each of the two components of the casing, FIG. 2 being a view in perspective of the casing closed by a turn of cable, FIG. 3 showing a longitudinal section through the casing taken on line A—A, FIG. 4 being a transverse view of the casing, FIG. 5 being a transverse view of two of the half-cheeks, FIG. 6 being a longitudinal view of a half-cheek, FIG. 7 being a similar section of another half-cheek which together with that in FIG. 6 forms a complete cheek, FIG. 8 being a transverse view of the half-cheeks not shown in FIG. 5, FIG. 9 being a longitudinal view of a half-core, FIG. 10 being a transverse view from the left of the half-core shown in FIG. 9, FIG. 11 being a longitudinal view of the other half-core of the casing, and FIG. 12 being a transverse section taken on line B—B of the half-core shown in FIG. 11;

FIGS. 13 and 14 show views in perspective of other constructional forms of components of casings according to the invention; and FIGS. 15 to 18 inclusive show diagrammatically a sequence of events which occur during the laying of a mooring line. In FIGS. 1 to 12, the casing is formed from a first component comprising half-cheeks 2 and 3 integral with the half-core 1, and a second component comprising half-cheeks 5 and 6 which are integral with the half-core 4. The casing is thus formed of two components each comprising a half-core and two half-cheeks. The half-cheeks, 2, 3, 5 and 6 contain respectively small apertures 7, 9, 8 and 10 which serve as locating means making it possible to arrange between the cheeks 2 and 3 and 5 and 6 members such as breaking wires of specific strength.

The space 14 formed between the two half-cores 1 and 4 allows the housing of a grapnel whose connecting cable 11 passes through an aperture of appropriate shape 15 and is wound about the two half-cores 1 and 4.

The separation of the two components of the casing is facilitated by a curved shape 13 given to an end of the portion of the half-cheeks 5 and 6 in contact with the half-cheeks 2 and 3 which also have a curved form 12 which matches the said curved form 13.

FIG. 13 is a view in perspective of one of two identical components of a casing comprising two half-cheeks 16 and a half-core 17 containing an aperture 18.

FIG. 14 is a perspective view of a first component of a casing in which the plane at which two half-cheeks 19 adjoin the corresponding half-cheeks of a second component of the casing differs from the plane of junction where a half-core 20 adjoins the other corresponding half-core.

FIG. 15 shows a casing comprised of two components 23, 24 being employed for the laying of a mooring line 29, just after immersion in a body of water 32. The two components 23, 24 are connected by articulated joints having staples 26 and a ring 27. Having negative buoyancy, the casing containing the grapnel 22 tends to sink and the mooring line unwinds until the grapnel is released.

Figure 1:
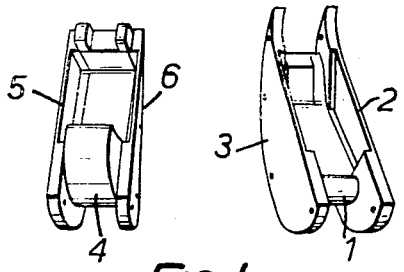
Figure 2:
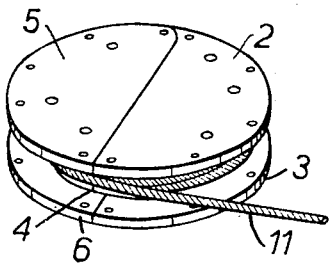
Figure 3:
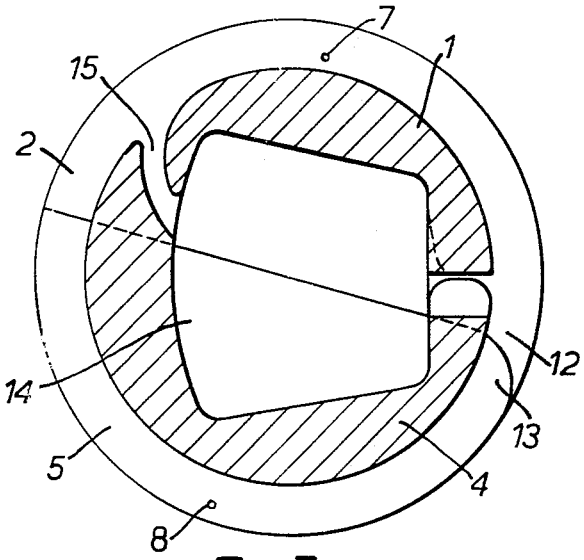
Figure 4:
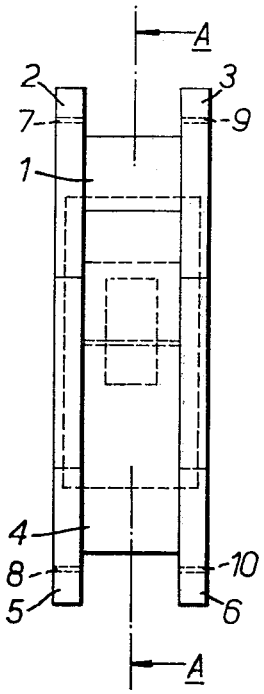
Figure 5:
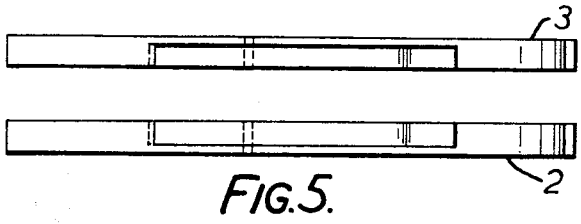
Figure 6:
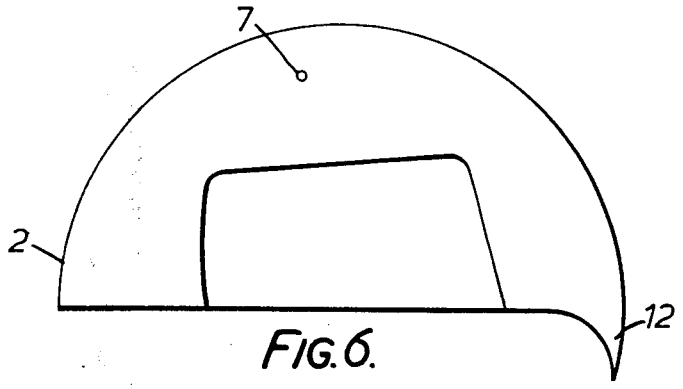
Figure 7:
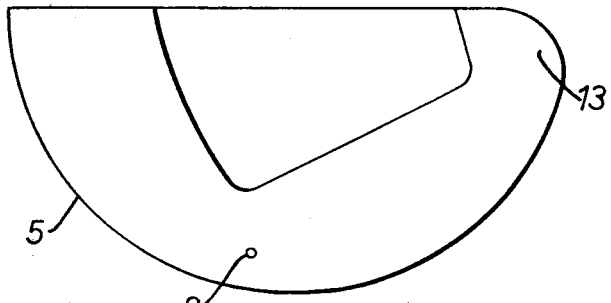
Figure 8:
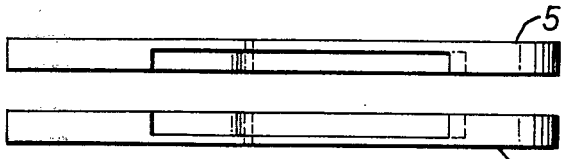
Figure 9:
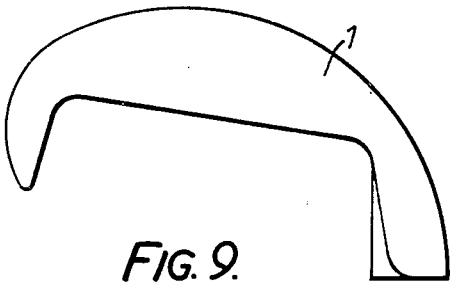
Figure 10:
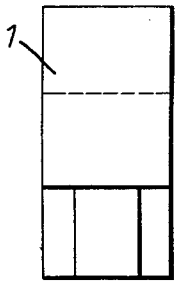
Figure 11:
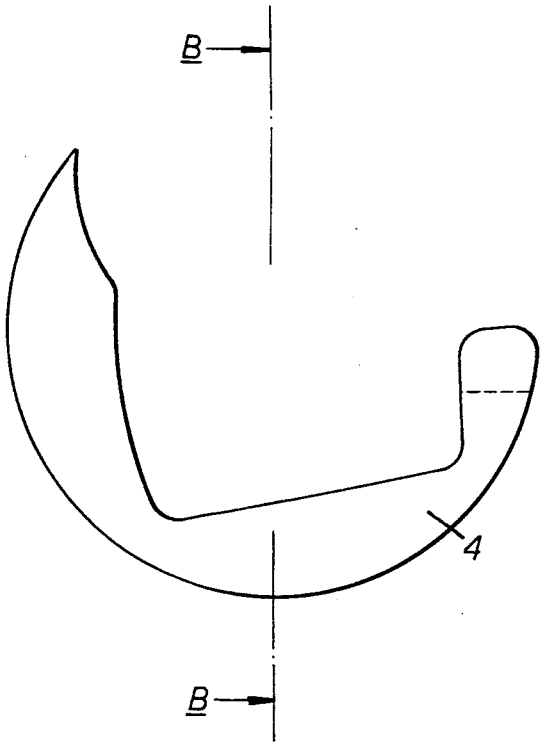
Figure 12:
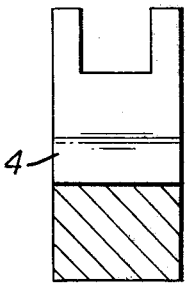
Figure 13:
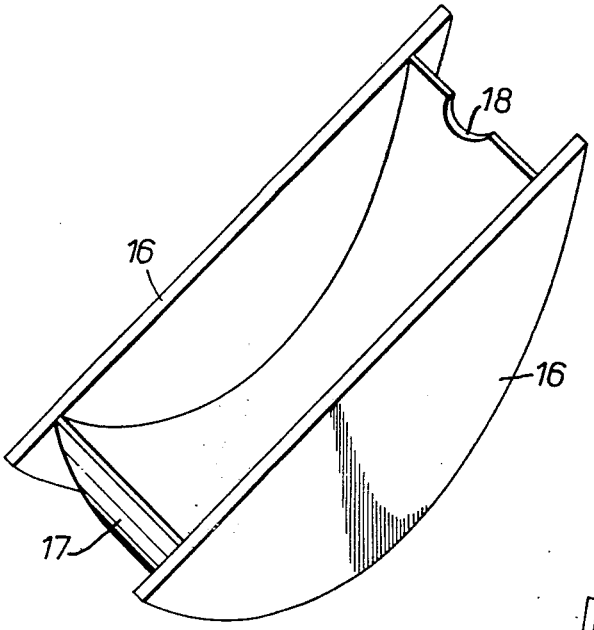
Figure 14:
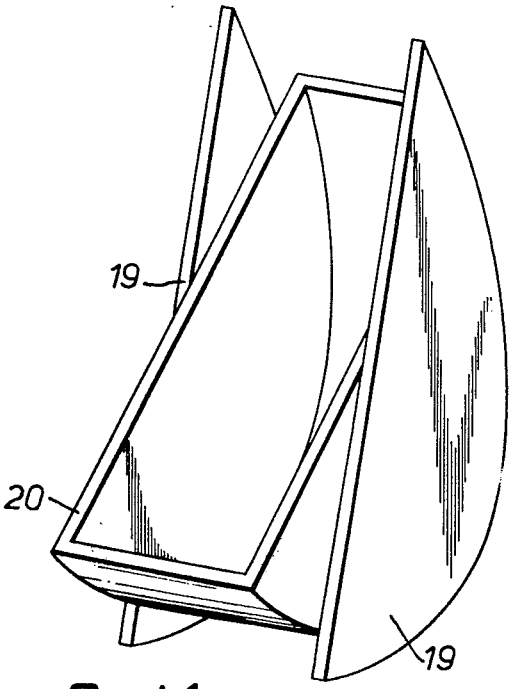
Figure 15:
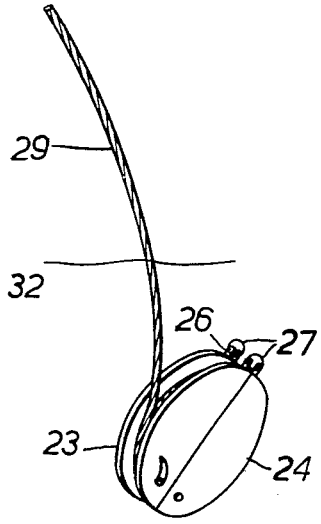
Figure 18:
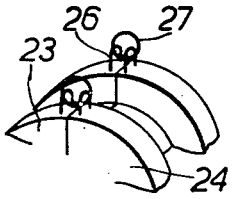
Figure 16:
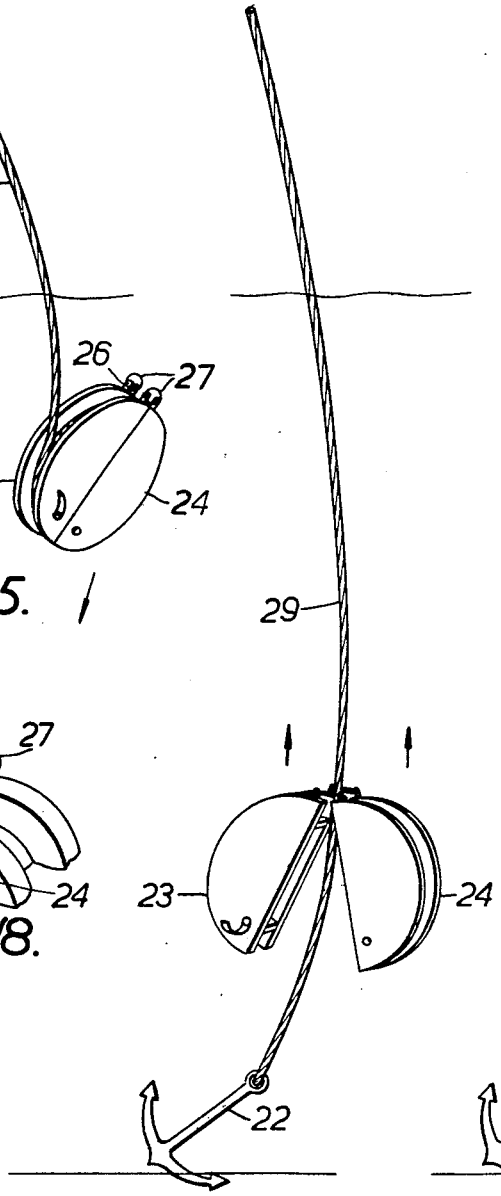
FIG. 16 shows the casing, just after opening to release the grapnel 22, sliding towards the surface of the body of water on the mooring line 29.
Figure 17:
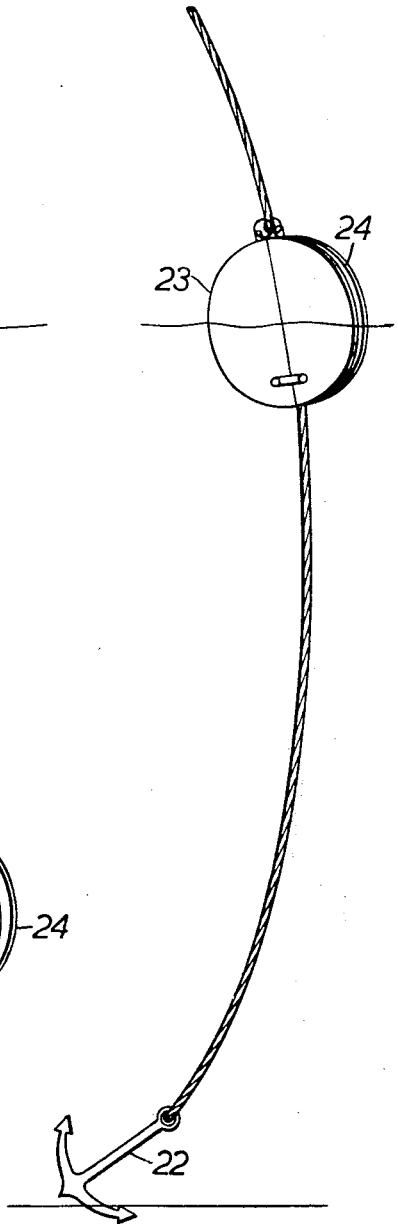
FIG. 17 shows the casing floating closed and empty on the surface and serving as a signalling buoy.

FIG. 18 shows an articulated joint comprising two staples 26 and a ring 27 connecting two components 23 and 24 of a casing.

What is claimed is:

1. A casing, for the housing of apparatus which is provided with a windable element, said casing comprising a central core with a surface of revolution defining an inner volume for said housing of apparatus, said core being formed of two hollow half-cylinders, each of said half-cylinders comprising two plane faces, said half-cylinders may be brought together to a closed position of said casing along a plane containing the common longitudinal axis of said half-cylinders and which may be moved relative to each other to an open position of said casing, two substantially circular cheeks formed of two contiguous half-cheeks having a mean radius greater than that of the said half-cylinders, each one of the four said half-cheeks being integral with one of the two plane faces of one of the two hollow half-cylinders of the said central core, an aperture located through the surface of revolution of said central core at a point where the said surface of revolution intersects the said plane, said aperture emerging in said inner volume, said aperture allowing passage of the said windable element the winding of which about the surface of revolution of the central core maintaining the casing in its closed position enclosing the said apparatus, the unwinding of the said windable element allowing the two hollow half-cylinders to break up, which allows egress of the said apparatus from within said casing.

2. A casing as claimed in claim 1 wherein the half cheeks are contiguous in an identical plane to that in which the half-cylinders are continguous.

3. A casing as claimed in claim 1 wherein the half cheeks are contiguous in a longitudinal plane which is different from the plane in which the half-cylinders are contiguous, which makes it possible to engage the two parts of the casing in one another.

4. A casing as claimed in claim 1 for use in the laying of mooring lines wherein the apparatus is a grapnel or other device to be submerged, said windable element is a flexible or hinged cable, the casing in said closed position having an intrinsic negative floating ability in closed position containing said apparatus and an intrinsic positive floating ability when it is substantially empty.

5. A casing as claimed in claim 4 wherein the two hollow half-cylinders are connected by at least one articulated joint for its binding with the other half-cylinder, said articulated joint being disposed so that the casing is slidably connected to the said windable element, said articulated joint being composed of two staples and at least one ring, said staples being each integral with one half-cylinder and said ring connecting together the said staples.

6. A casing as claimed in claim 1 for use in a device for the recovery at sea of containers dropped from aircraft wherein the said casing comprises said cheeks and wires, said wires linking said cheeks and wires and said wires being of a strength such that they break when the windable element wound on the casing unwinds at positions such that the surface of revolution of the central core of the casing has a maximum radius less that that between any one of the said wires and the major axis of the casing.

7. A casing as claimed in claim 6 wherein said wires are fixed in apertures formed in the thickness of the cheeks.

8. A casing as claimed in claim 1 wherein the end of the contact surface of the half-cheeks diametrically opposite the end adjacent to the aperture in the half-core through which the said windable element may issue is curved in the direction in which the casing rotates when the windable element unwinds.

* * * * *